United States Patent [19]

Girardier

[11] 4,240,238

[45] Dec. 23, 1980

[54] GRIPPING MEANS FOR MACHINE FOR FILLING AND CLOSING FLEXIBLE TUBES

[75] Inventor: Raymond Girardier, Mont l'Hermite, France

[73] Assignee: Cotuplas S.A., Zone industrielle, Sainte Menehould, France

[21] Appl. No.: 52,430

[22] Filed: Jun. 26, 1979

[30] Foreign Application Priority Data

Aug. 25, 1978 [FR] France ..... 78 25438

[51] Int. Cl.[3] ..... B65B 51/14

[52] U.S. Cl. ..... 53/373; 156/583.9

[58] Field of Search ..... 53/373, 371, 479; 156/583.8, 583.9

[56] References Cited

U.S. PATENT DOCUMENTS

| | | | |
|---|---|---|---|
| 2,751,965 | 6/1956 | Miller | 53/373 X |
| 3,119,728 | 1/1964 | Janapol | 156/583.9 |

*Primary Examiner*—Travis S. McGehee

*Attorney, Agent, or Firm*—Dennison, Messerole, Pollack & Scheiner

[57] ABSTRACT

A pair of jaws operable in a common plane between an open and closed position for the selective clamping of a plastic tube or the like, one of the jaws being selectively shiftable out of the common plane in the open position and automatically returned to the common plane upon a closing movement of the jaws.

5 Claims, 5 Drawing Figures

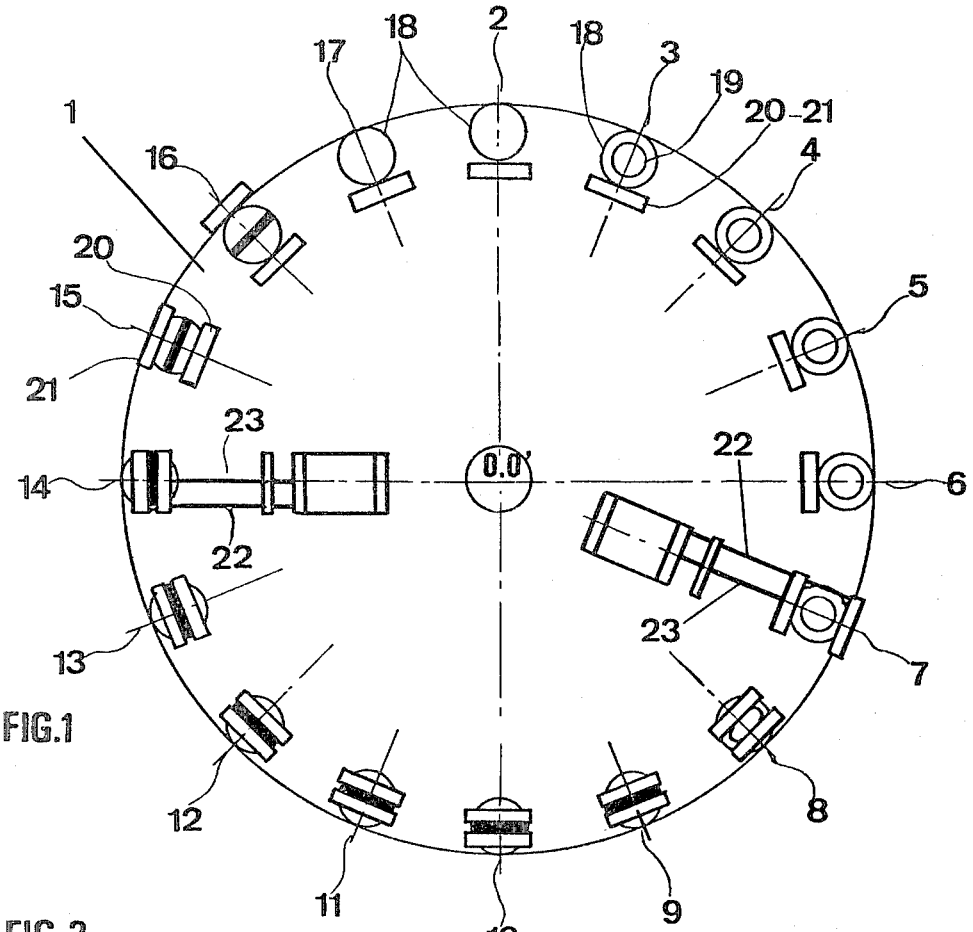
FIG.1
FIG.2
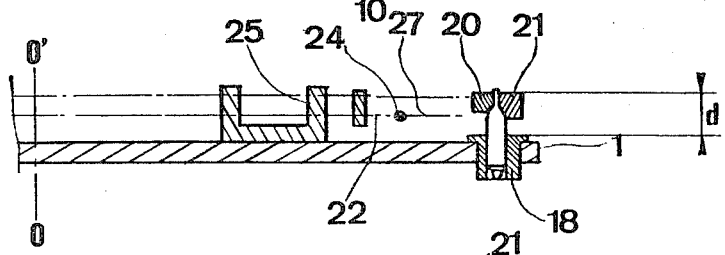
FIG.3
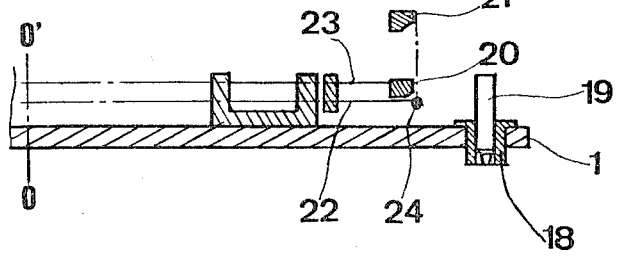

GRIPPING MEANS FOR MACHINE FOR FILLING AND CLOSING FLEXIBLE TUBES

For filling and then closing tubular packages made of flexible material, such as flexible tubes, the present practice is to use automatic machines operating at high speeds in the order of one package per second.

Many of these flexible tubes are at present made of plastics or a laminated complex consisting of one or more layers of plastics.

Plastics materials such as polyethylene, polypropylene and nylon are more elastic than malleable and give the walls of the tube a "memory". After temporary deformation the wall tends to return to its initial shape. Thus when an empty plastics tube is closed by mechanical gripping it tends to return to its initial tubular shape on being released.

Tubes made of plastics or a complex consisting of metal and plastics cannot be sealed simply by folding and corrugating them, as is the practice with aluminium tubes, which remain folded and flattened.

Thus tubes where at least the internal surface is made of thermoplastic material are sealed by welding the internal surface to itself. The tube has to be gripped before welding and kept gripped long enough for the weld to cool and resist the tendency of the tube to return to its initial shape.

In order to increase operating speeds, the ends of the tubes which have to be welded are generally pre-heated as described in French Pat. No. 2,176,558. This method involves the use of gripping means of the vice type, with the jaws denoted by references 21 and 22 in this specification. The jaws accompany the tubes in their movement within the machine. They have to remain closed in order to keep the end of each tube closed during the pre-heating period, the welding period and the cooling period.

French Pat. No. 1,069,414 describes an automatic machine in which flexible plastics tubes are filled, then closed by gripping and welding. The machine further comprises gripping jaws which accompany the tubes in their movement. The jaws, which are denoted by references 20 and 21 in this patent, are displaced on both sides of the tubes by sliding on guides in a horizontal plane above the table of the machine.

It will be readily understood that the jaws occupy a certain height above the table, which cannot then be used for other devices. The other operations required of the machine, such as positioning the tubes, guiding them, adjusting them by guide marks, marking, filling them, cutting the ends and ejecting, have to be carried out by devices located above or below the jaws.

Particularly when an empty tube is being positioned, it has to be dropped through the jaws of the gripping means, without being accompanied, to the upper level of the tube carrier which forms its seating on the machine. Although the opening in the seatings on the machine widens out, the charging of the tubes is a relatively risky operation. Tubes may fail to engage correctly in their seatings, making it necessary to interrupt manufacture.

After filling and sealing, a tube cannot thereupon be picked up immediately at the level of its seating. It has to be projected vertically so as to cover a distance corresponding to the thickness of the jaws, without any guidance. The orientation which the tube has relative to its axis on leaving the machine is not reliable, and this may create difficulties in subsequent operations.

Finally, the operation of adjusting the tube by guide marks, so that either the longitudinal weld of the tube or the pre-printed lettering can be arranged in a specific position relative to the transverse sealing weld, cannot be carried out at the level of the jaws. This aligning operation can only be carried out by a photo-electric cell located above the jaws, which would necessitate needlessly lengthening the tube above the transverse welding line then cutting it to the correct length.

The subject matter of the invention is an arrangement of the vice gripper type in which one of the jaws, when not in operation but in the open position, recedes above its working plane by being raised substantially above the other jaw.

In a machine with a revolving table similar to that described in French Pat. No. 1,069,414, the jaw which is raised is the outer one.

For this purpose the two jaws are each actuated by at least one control rod sliding radially over the machine. The rod controlling the outer jaw has its end hinged for movement in a vertical plane, over a length corresponding substantially to the distance between the two jaws in the open position, while a return means endeavours to keep the hinged end of the rod in a vertical position and thus raise the outer jaw.

The inner jaw is displaced in a horizontal plane bearing on the control rod of the outer jaw. Thus when it is closed by moving towards the periphery of the machine, it bears on the end of the control rod of the outer jaw and returns that rod to the horizontal position. This brings the outer jaw into the working plane of the inner jaw thus enabling the two jaws to carry out their gripping function in a horizontal plane.

The invention will be better understood from the description of a special example which follows. This is illustrated in the accompanying drawings, in which:

FIG. 1 is a diagrammatic plan view of a rotating table,

FIG. 2 is a vertical cross-section through the table, passing through the axis of the seating for a tube, with the two jaws gripped to weld the orifice of the tube.

FIG. 3 is a half section through the table, taken in a vertical plane passing through the axis of the seating for a tube when the two jaws are open.

Figure 4:
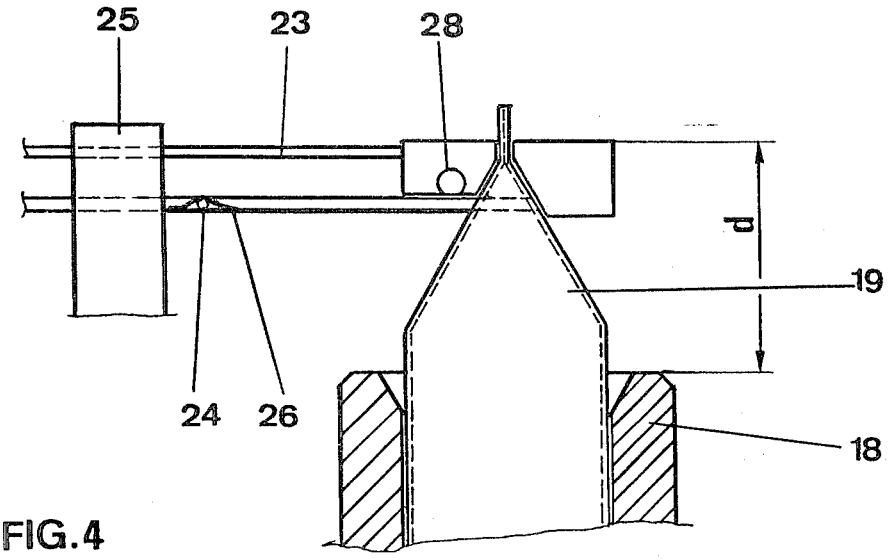
FIG. 4 shows a detail of the jaws in the closed position corresponding to FIG. 2 and, FIG. 5 shows a detail of the jaws in the open position with the outer jaw raised, as in FIG. 3.

Referring to FIG. 1, this is a diagram representing a revolving table 1 which turns around a vertical axis 00'. The table 1 has 16 working stations numbered from 2 to 17 and each comprising a seating 18 to guide a tube 19. Each station also has a pair of jaws 20–21 rigidly connected to the table by control rods 22–23.

In the example illustrated the seating 2 is empty. It will be fitted with a tube 19 similar to that which can be seen in a plan view at station 3 in its seating 18.

Station 3 is the station for adjusting the vertical position of the tube 19. Station 4 is used to tighten the stopper.

Station 5 is a station for printing the tube by guide marks. The tube 10 is set in rotation and stopped for a defined position of the guide mark, so that the printing has a defined position relative to the line of transverse welding carried out at the following stations.

Station 6 is a filling station.

Station 7 is a free station.

Station 8 is for setting the tube to the correct height and possibly cutting it.

Stations 9–10–11–12 are for pre-heating then welding the tube; the jaws 20–21 are clamped over the orifice of the tube to close it definitively.

Station 13 is for corrugating, marking and cooling.

Station 14 is a stabilizing station.

Station 15 is for cutting to the correct length, and stabilizing.

Station 16 is a stabilizing station.

Station 17 is an ejecting station.

Figure 5:
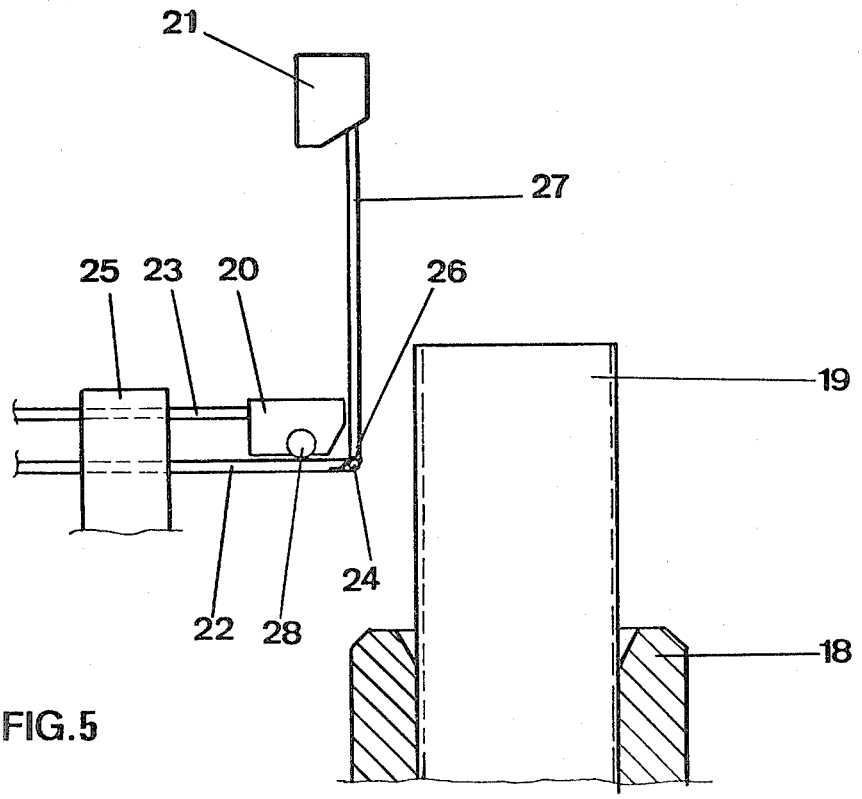

In addition to stations 9, 10, 11 and 12, where the jaws are necessarily closed for gripping and heating as shown in FIG. 2, the outer jaw 21 is also lowered at stations 7, 8, 13, 14, 15 and 16. At stations 2, 3, 4, 5, 6 and 17, conversely, the outer jaw 21 is raised as shown in FIG. 2 or 5.

This movement is possible because the jaw is actuated by at least one rod 22 with its end hinged around a horizontal spindle 24.

Thus at feeding stations 2 and 17 the tube 19 may either be accompanied or may be released at the level of its seating 18. When the tube 19 is ejected at 17 in particular, it is not necessary to project it above the height d in order to make it clear the level of the outer jaw 21 which is raised.

At station 5 printing can similarly take place at any level of the jaws, over the whole vertical distance d, even at the level of the jaws 20, 21. Without the arrangement for raising the jaw 21 it would be necessary to print below or above the said jaw. This would necessitate either extending the tube beyond the closing line or lowering the seating 18 and thereby reducing the guiding height.

Referring now to FIGS. 4 and 5, these show in detail the arrangement which enables the outer jaw 21 to be raised above the jaw 20 when it is in the open position.

The jaws 20 and 21 are actuated by respective rods 22 and 23 which slide radially and are guided by a support 25.

The rod 22 has a hinge pin 24 and a spring 26 which endeavours to return the end 27 of the rod 22 to the vertical position, and thus the jaw 21 to the raised position, substantially above the inner jaw 20.

The inner jaw 20 is integral with a roller 28 which runs along the rod 22.

Thus when the rod 23 moves outwardly while the rod 22 is retracted towards the center of the table to bring the two jaws 20 and 21 together, the roller 28 passes directly above the pin 24 and pushes the end 27 of the rod 22 into a horizontal position. The two jaws 20 and 21 are then facing one another in the same horizontal plane and can effectively grip a tube 19.

Here the two jaws 20 and 21 are each actuated by one respective rod, but obviously each jaw 20, 21 could be actuated by a pair of rods which were symmetrical relative to the radial plane passing through the axis of the corresponding seating 18.

It should be noted that, by keeping the jaws apart with the outer jaws 21 raised, a machine of the type described may be used equally well for filling rigid bottles or jars as for fixing flexible tubes.

I claim:

1. For use in a packaging machine, double-jaw gripping means comprising first and second jaws, control means for causing relative movement of said jaws in a common plane between an open and a closed position, means for selectively raising said first jaw relative to said second jaw and out of said common plane of the jaws, and means restricting the raising of said first jaw except in the open position of the jaws, said control means for causing relative movement of the jaws includes an elongated control member having a romote end mounting said first jaw, said means for selectively raising said first jaw including a hinged joint in said control member inward of the jaw mounting remote end.

2. The gripping means of claim 1 wherein the means for selectively raising said first jaw further includes spring means at said hinge joint biasing the outer portion of the control member, between the hinge joint and the romote end, upward out of the common plane of the jaws.

3. The gripping means of claim 2 including a second elongated control member with a remote end mounting said second jaw, said means restricting the raising of said first jaw being mounted on said second jaw and selectively movable between a first position overlying the portion of the first control member between the hinge joint and the remote end thereof to maintain the jaws in a common plane against the biasing force of the spring means, and a second retracted position to the opposite side of the hinged joint, allowing an unobstructed raising of the remote end of the first control member by said spring means.

4. The gripping means of claim 3 wherein the length of the portion of the first control member between the hinged joint and the remote end thereof is substantially equal to the maximum space in between the jaws in the open position thereof.

5. For use in a packaging machine, double-jaw gripping means comprising first and second jaws, control means for causing relative movement of said jaws in a common horizontal plane between an open and a closed position for selective gripping engagement with and disengagement from a package end positioned therebetween, means for selectively raising said first jaw relative to said second jaw, out of said common horizontal plane of the jaws and into general vertical alignment with said second jaw, and means restricting the raising of said first jaw except in the open position of the jaws.

* * * * *